United States Patent [19]

Pawlak

[11] Patent Number: 4,552,473

[45] Date of Patent: Nov. 12, 1985

[54] RIBBON FEED MECHANISM

[75] Inventor: Stephen M. Pawlak, Cortland, N.Y.

[73] Assignee: SCM Corporation, New York, N.Y.

[21] Appl. No.: 660,662

[22] Filed: Oct. 15, 1984

[51] Int. Cl.[4] ..... B41J 35/28; B41J 33/24

[52] U.S. Cl. ..... 400/208; 400/228

[58] Field of Search ..... 226/53, 193; 242/62, 242/65; 400/228, 223, 224, 227, 227.1, 235, 235.1, 236, 207, 208, 208.1

[56] References Cited

U.S. PATENT DOCUMENTS

| | | | |
|---|---|---|---|
| 4,317,636 | 3/1982 | Hume | 400/228 X |
| 4,319,850 | 3/1982 | Rello et al. | 400/208 X |
| 4,337,001 | 6/1982 | Cappotto | 400/234 X |

OTHER PUBLICATIONS

"Spiked Ribbon Driver Assembly" IBM Technical Disclosure Bulletin, vol. 25, No. 10, Mar. 1983, p. 5376, by Davis et al.

*Primary Examiner*—Edgar S. Burr
*Assistant Examiner*—Charles A. Pearson
*Attorney, Agent, or Firm*—Kenneth W. Greb; Ernest F. Weinberger

[57] ABSTRACT

A ribbon feed mechanism for printing machines has a toothed wheel rigidly mounted on a drive shaft at an angle relative to a plane perpendicular to the drive shaft axis. The toothed wheel will penetrate layers of outer convolutions of a roll of film ribbon on a take-up spool at varying locations relative to the ribbon width for feeding the film ribbon with equal length increments more consistently.

4 Claims, 7 Drawing Figures

United States Patent [19]

Horeschi et al.

[11] Patent Number: 4,552,474

[45] Date of Patent: Nov. 12, 1985

[54] BACKSPACE DEVICE IN TYPEWRITER

[75] Inventors: Giancarlo Horeschi; Gian P. Barozzi, both of Tokyo, Japan

[73] Assignee: Tokyo Juki Industrial Co., Ltd., Tokyo, Japan

[21] Appl. No.: 550,291

[22] Filed: Nov. 9, 1983

Related U.S. Application Data

[63] Continuation-in-part of Ser. No. 287,692, Jul. 28, 1981, abandoned.

[30] Foreign Application Priority Data

Aug. 11, 1980 [JP] Japan ..... 55-110952

[51] Int. Cl.[4] ..... B41J 19/62

[52] U.S. Cl. ..... 400/310; 400/307.2; 400/312; 400/478; 400/665

[58] Field of Search ..... 400/161.1, 166, 307.2, 400/308, 309, 310, 311, 312, 478, 665

[56] References Cited

U.S. PATENT DOCUMENTS

| | | | |
|---|---|---|---|
| 2,879,876 | 3/1959 | Palmer et al. | 400/161.1 |
| 3,366,215 | 1/1968 | Hosey et al. | 400/310 |
| 3,618,736 | 11/1971 | Abell, Jr. et al. | 400/166 |

OTHER PUBLICATIONS

IBM Technical Disclosure Bulletin, "Self-Phasing Backspace Mechanism", Schaefer, vol. 12 No. 12, May 1970, p. 2192.

IBM Selectric Typewriter Service Manual, dated May, 1975, pp. 80, 101, 105, 113, 117.

*Primary Examiner*—Ernest T. Wright, Jr.
*Attorney, Agent, or Firm*—Koda and Androlia

[57] ABSTRACT

A backspace device in a typewriter comprising: an interposer operable by the operation of a key lever; a cycle bail operable by the interposer; a cycle clutch for intermittently transmitting a driving force from a driving source to a main shaft so that the main shaft can be rotated by a predetermined number of times in association with the cycle bail; an actuating bail for performing a cycle of a motion along a moving path of a predetermined mode by a full turn of the main shaft, while rendering to the interposer a motion in a direction of the interposer leaving the cycle bail during the motion; a backspace link for moving in association with the interposer during the leaving motion of the interposer; a backspace rack extending laterally of the typewriter, supported rotatably about an axis laterally disposed and turned to a working position by the backspace link; and a backspace pawl fastened onto a carriage so that it can be reciprocated a predetermined distance in the lateral direction by a cam rotatable integrally with the main shaft and having a toothed portion to be meshed with the backspace rack rotated to the working position; wherein the carriage is retracted by a predetermined value of pitch along the main shaft by a reaction force generated at a portion of the engagement of the backspace pawl with the backspace rack by a motion of the backspace pawl.

Figure 1:
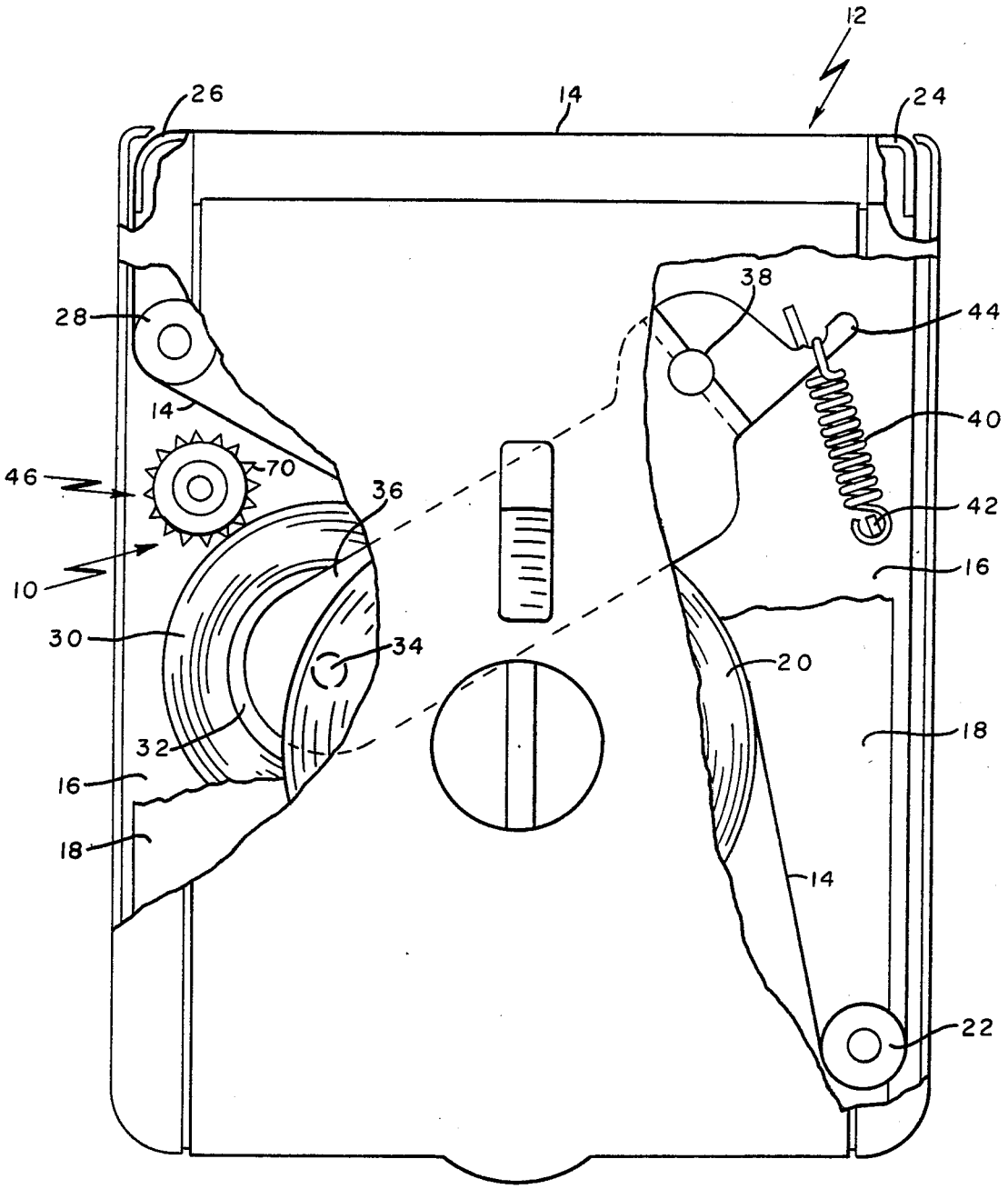
Figure 2:
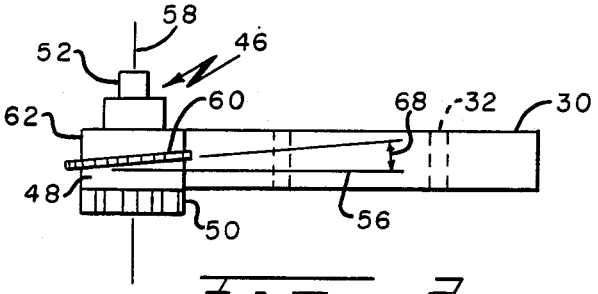
Figure 3:
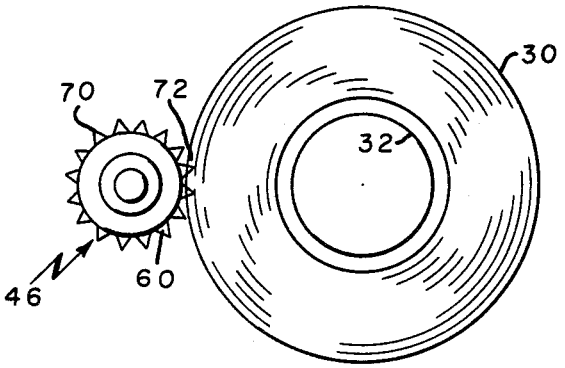
Figure 4:
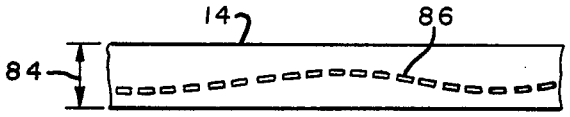
Figure 7:
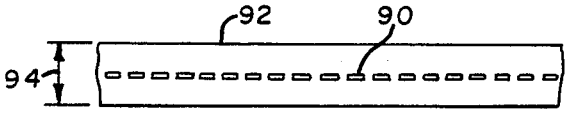
PRIOR ART Fig 7
Figure 5:
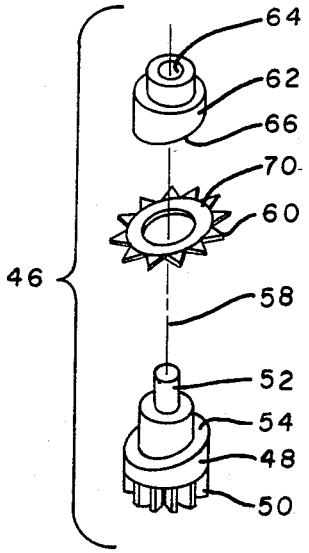
Figure 6:
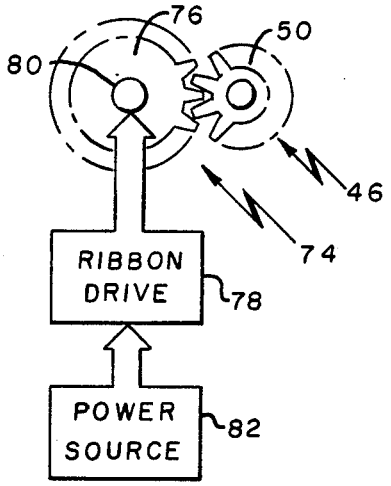

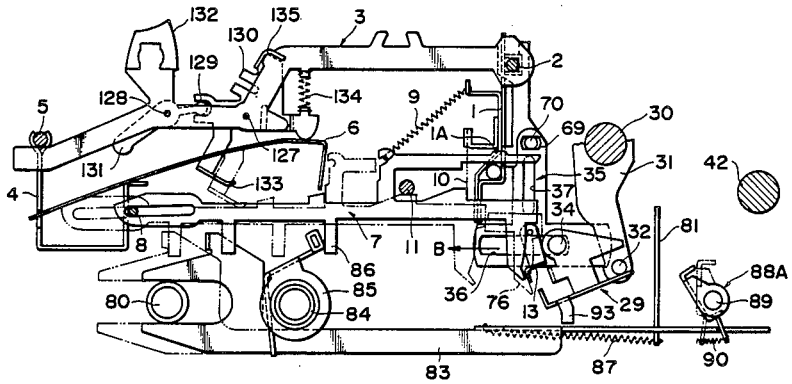

3 Claims, 14 Drawing Figures